US011794793B2

(12) United States Patent
Valenzuela Romero

(10) Patent No.: US 11,794,793 B2
(45) Date of Patent: Oct. 24, 2023

(54) COMPACT BRAKING SYSTEM FOR ZIP-LINE

(71) Applicant: Luis Guillermo Valenzuela Romero, Nuevo Leon (MX)

(72) Inventor: Luis Guillermo Valenzuela Romero, Nuevo Leon (MX)

( * ) Notice: Subject to any disclaimer, the term of this patent is extended or adjusted under 35 U.S.C. 154(b) by 189 days.

(21) Appl. No.: 17/394,802

(22) Filed: Aug. 5, 2021

(65) Prior Publication Data

US 2023/0041957 A1 Feb. 9, 2023

(51) Int. Cl.

| | |
|---|---|
| ***B61H 9/02*** | (2006.01) |
| ***A63G 21/22*** | (2006.01) |
| ***B61H 9/04*** | (2006.01) |

(52) U.S. Cl.

CPC ..... *B61H 9/02* (2013.01); *A63G 21/22* (2013.01); *B61H 9/04* (2013.01)

(58) Field of Classification Search

CPC ..... B61H 13/20; A63G 21/22
USPC ..... 104/117.1, 113
See application file for complete search history.

(56) References Cited

U.S. PATENT DOCUMENTS

| | | | | |
|---|---|---|---|---|
| 10,023,208 | B2 | 7/2018 | Brown | |
| 10,730,535 | B2 | 8/2020 | Hackett | |
| 10,746,239 | B2 | 8/2020 | Dreher | |
| 10,807,613 | B2 | 10/2020 | Richardson | |
| 2006/0027134 | A1* | 2/2006 | Steele | B61B 12/06 104/113 |
| 2012/0291658 | A1 | 11/2012 | Cylvick | |
| 2014/0158012 | A1* | 6/2014 | Hackett | B61H 9/02 188/65.1 |
| 2017/0259181 | A1* | 9/2017 | Cylvick | A63G 21/22 |
| 2022/0281493 | A1* | 9/2022 | Hackett | F16D 63/008 |

FOREIGN PATENT DOCUMENTS

| | | | |
|---|---|---|---|
| MX | 2018/014903 | A | 11/2018 |
| MX | 2018014903 | A * | 11/2018 |

* cited by examiner

*Primary Examiner* — S. Joseph Morano
*Assistant Examiner* — James William Jones
(74) *Attorney, Agent, or Firm* — LUCAS & MERCANTI, LLP

(57) ABSTRACT

A compact braking system for zip-line that brakes a sliding car including an anti-return trapping device that traps the sliding car preventing its return by a zip-line cable and a braking device that transfers and dissipates the energy of the arrival impact of the slide car without the use of one or more cables and/or elements external to it and without the activation of any operator.

19 Claims, 8 Drawing Sheets

COMPACT BRAKING SYSTEM FOR ZIP-LINE

FIELD OF THE INVENTION

The present invention is related to the technological field of zip-line systems, particularly it relates to a compact braking system for zip-line.

BACKGROUND OF THE INVENTION

Today, there are countless technological developments dedicated to slowing down a zip-line sliding car during use. Regarding the above, zip-line systems have sought to implement braking systems or devices that allow guaranteeing the safety of users before reaching the arrival platform. As is known, the speed of the sliding car increases during the travel due to the inclination of the cable that supports it and the force generated by gravity; If the speed of the sliding car is not controlled and reduced, before its arrival at the end point of the travel, the safety of the user would be compromised when the sliding car hits the arrival platform. Such impact could be fatal for the user.

Given the need set forth in the previous paragraph, the different efforts dedicated to zip-line braking systems or devices known in the prior art, have implemented different ways to control and decrease the speed of the sliding car before reaching the arrival platform; however, said efforts depend on an operator or the user himself for their activation, or they depend on one or more external cables, independently of the main zip-line cable, and/or elements external to these for their activation and braking.

Since braking devices or systems are comprised of a high number of external springs, other major problems of these efforts are that these are large and, therefore, the zip-line system must include structures (arrival platforms) large to withstand the impact of the sliding car, which are difficult to install. In turn, said braking devices or systems do not have an anti-return/backstop trapping device, such as the one disclosed in the present invention, an anti-return trapping device that traps and prevents the sliding car from returning on the zip-line after the arrival impact. In addition, such anti-return trapping device can be detached from the braking system to be placed at a certain distance on the zip-line. Other functions of the anti-return trapping device of the present invention are that it can be carried through the zip-line cable, by means of cables or external elements, until reaching and trapping the sliding car, in case it does not impact with the braking system.

Now, it is of the utmost importance to highlight the substantial differences of the present invention against the identified prior art. For example, the Mexican patent application document MX/a/2018/014903, which belongs to the same applicant, discloses a zip-line system with an autonomous braking system that comprises a trapping device with anti-rebound and a general braking block, similar to that of the present invention. However, this system is large by making use of external springs, occupying more than half the space on the arrival platform. The compact braking system for zip-line of the present invention, by comprising springs within it, does not make use of external springs, thus allowing it to be compact and much lighter. Also, the compact braking system for zip-line of the present invention, by comprising an internal damping system that includes springs within it, a rotating union and rolling/bearing elements, can be used for different users of different weights and at different speeds, generating smooth and safe braking for the user, even with a lot of weight and at very high speeds. While the zip-line system with autonomous braking system of the Mexican patent application MX/a/2018/014903, works well only for medium to low speeds, that is, for very high speeds the braking is very strong, abrupt and sudden.

The Mexican patent application MX/a/2018/014903 performs braking by means of the dissipation of energy by springs and transfer of energy to a general braking block, which generates a lever movement; however, the present invention performs smooth and safe braking by dissipating energy through an accordion movement and a hinge movement and transfer of energy to a braking device, using lever movement as a secondary embodiment. That is, the Mexican patent application MX/a/2018/014903 invention brakes by means of external springs, whereas the present invention brakes through accordion movement and hinge movement. Specifically, the use of the internal springs of the present invention is not to brake the sliding car but to absorb the impact of the user and to ensure smooth and gradual braking.

On the other hand, U.S. Pat. No. 10,746,239B2 discloses a portable emergency braking system for zip-line with the purpose of completely braking or slowing down the sliding car, which can work in two ways, that it rolls towards the user or that it is held in some part of the zip-line. Furthermore, the system disclosed by U.S. Pat. No. 10,746,239B2 brakes by means of friction through several pads, that is, the user impacts the brake generating a hinge and lever movement in said pads, thereby pinching the zip-line cable. However, the present invention comprises a braking device that includes two blocks, wherein, thanks to the impact of the sliding car, one of them enters and leaves the other indefinitely, generating an accordion movement until smooth, safe, and total braking of the slide car is achieved. That is, U.S. Pat. No. 10,746,239B2 brakes through friction through pads, whereas the present invention brakes through accordion movement and hinge movement, movements that dissipate and transfer energy. Specifically, the use of the internal springs of the present invention is not to brake the sliding car but to absorb the impact of the user and to ensure smooth and gradual braking.

Furthermore, U.S. Pat. No. 10,746,239B2 does not include a universal anti-return trapping device, such as that disclosed in the present invention, that is capable of trapping any commercial zip-line sliding car and separating from the braking device, so that it can be positioned, at a distance before of this one, first to catch the sliding car and, later to be caught by the braking device.

Another relevant document found in the state of the art is U.S. Pat. No. 10,730,535B2, which is related to an emergency stopping device for zip-line that comprises a slip and grip knot, such as a Prusik knot, which is tied to the zip-line cable and that is tensioned, generating friction for braking, when the sliding car impacts. One of the great differences between the device of U.S. Pat. No. 10,730,535B2 and the system of the present invention is that the device of this uses one or more cables, independently of the main zip-line cable, and/or elements external to these for its activation and braking. Furthermore, U.S. Pat. No. 10,730,535B2 does not dissipate energy by springs or transfer energy to a braking device, which generates an accordion movement and a hinge movement for smooth and safe braking. That is, U.S. Pat. No. 10,730,535B2 brakes by means of friction through slip and grip knot, while the present invention brakes through accordion movement and hinge movement, movements that dissipate and transfer energy. Specifically, the use of the internal springs of the present invention is not to brake the sliding car but to absorb the impact of the user and to ensure smooth and gradual braking.

On the other hand, U.S. Pat. No. 10,023,208B2 is directed to a sliding car including a rotating brake block, wherein said rotating brake block comprises a coupling cam that prevents the sliding car from moving to the side opposite to the direction of movement. As can be seen, the purpose of the previous invention is to slow down the backward movement of the sliding car when it does not reach the arrival platform, thus preventing the sliding car from moving back to the lowest midpoint of the zip-line. Purpose that is totally different from that of the present invention, which lies in braking the sliding car in the direction of movement. In addition to the foregoing, this US patent application document does not include a universal anti-return trapping device, such as that disclosed in the present invention, that is capable of trapping any commercial zip-line sliding car and separating from the braking device. Finally, U.S. Pat. No. 10,023,208B2 does not dissipate energy by springs or transfer energy to a braking device, which generates an accordion movement and a hinge movement for smooth and safe braking.

Now, U.S. Pat. No. 10,807,613B2 is focused on the disclosure of a sliding car with a brake integrated therein, wherein said brake comprises a stop that compresses when it collides with a receiver, mobilizing the brake towards the cable for friction braking. One of the substantial differences between this and the present invention is that the uses a receiver comprised of one or more springs external to the system for braking the sliding car, while the compact braking system for zip-line of the present invention comprises an internal damping system that includes springs within it, a rotary joint and rolling elements. Another substantial difference is that U.S. Pat. No. 10,807,613B2 utilizes friction braking only, while the compact braking system for zip-line of the present invention transfers and dissipates energy to a braking device, which generates accordion movement and hinge movement for smooth and safe braking. That is, U.S. Pat. No. 10,807,613B2 brakes through friction through the stop, whereas the present invention brakes through accordion movement and hinge movement, movements that dissipate and transfer energy. Specifically, the use of the internal springs of the present invention is not to brake the sliding car but to absorb the impact of the user and to ensure smooth and gradual braking.

Finally, US patent application document US20120291658A1 refers to a user sliding car that is attached to a brake block containing brake pads that generate friction with the zip-line cable. Like the present invention, the sliding car of this US patent application is coupled to a compact braking block, however, the sliding car of this US patent application document is not universal, as it is fully designed to couple only with the braking block from the same document. The anti-return trapping device of the present invention is universal and is capable of trapping any commercial zip-line slide car and separating from the braking device, so that it can be placed at a distance before it to first catch the sliding car and subsequently being caught by the braking device. Another substantial difference is that this US patent application document uses friction braking only, whereas the compact braking system for zip-line of the present invention transfers and dissipates energy to a braking device, which generates an accordion movement and a hinged movement for smooth and safe braking. That is, US patent application document US20120291658A1 brakes through friction through the braking pads, whereas the present invention brakes through accordion movement and hinge movement, movements that dissipate and transfer energy. Specifically, the use of the internal springs of the present invention is not to brake the sliding car but to absorb the impact of the user and to ensure smooth and gradual braking.

It is very important to mention that the present invention, by dissipating the energy through an accordion movement and a hinge movement and transferring the energy to a braking device, there is no wear of friction elements and this significantly reduces maintenance and prolongs the life of the parts included therein. Also, and related to the above, the present invention generates a lever movement that brings a wear element into contact with the zip-line cable; however, this movement is a secondary embodiment and the system of the present invention can do without with this movement. Finally, due to the versatility and compression of the system of the present invention, a simple and low-cost installation is guaranteed. For the installation of this system, no additional elements or structures are required in the zip-line cable, that is, secondary cables, posts, anchors, special platforms or any other external installation element are not required. The compact braking system for zip-line of the present invention is universal, it is capable of being installed on any zip-line cable of any size and by anyone.

These differences are also very noticeable against all the prior art documents cited above.

BRIEF DESCRIPTION OF THE INVENTION

The present invention relates to a compact, automatic, with anti-lock, integrated damping and anti-return braking system for zip-lines, which works by dissipating and transferring energy and which aims to guarantee an effective and safe braking for the user, without the need to be activated by an operator and/or user and without the need to use one or more cables and/or external elements. The compact braking system for zip-line comprises an anti-return trapping device that traps a sliding car preventing it from returning along the zip-line cable after the arrival impact.

Once the sliding car is trapped by the anti-return trapping device, they slide along the zip-line cable until they reach a braking device, comprised of two braking blocks, which transfers and dissipates the energy of the impact of the arrival of the sliding car. Similar to the sliding car, the anti-return trapping device is trapped by the braking device.

Furthermore, the backstop trapping device can be detached from the braking device to be positioned at a distance on the zip-line. Other functions of the anti-return trapping device are that it can be carried through the zip-line cable, by means of cables or external elements, until reaching and catching the sliding car, in case the sliding car does not impact with said anti-return trapping device.

The transfer and dissipation are achieved thanks to two different movements that are carried out by the compact braking system for zip-line, which are: a hinge movement generated thanks to a rotary joint and a plurality of elastic elements and an accordion movement generated thanks to the entry of a braking block into the other and to the resistance exerted by said plurality of elastic elements. As a secondary embodiment, a lever movement is generated by the braking device, thanks to the entry of a braking block into the other applying friction of a wear element with the zip-line. The above movements guarantee a gradual, smooth and total braking of the sliding car.

By proposing the novel technical features previously explained, a total braking of the sliding car is achieved, thus guaranteeing effective and safe braking for the user.

Other objects, advantages, and novel aspects of the invention will become more apparent from the following detailed description in conjunction with the accompanying drawings.

BRIEF DESCRIPTION OF THE DRAWINGS

Aspects that are considered features of the present invention will be set forth with particularity in the appended claims. However, the invention itself, both by its organization and its method of operation, together with other objects and advantages thereof, will be better understood in the following description, when read in connection with the accompanying drawings, in which:

DETAILED DESCRIPTION OF THE INVENTION

Figure 1:
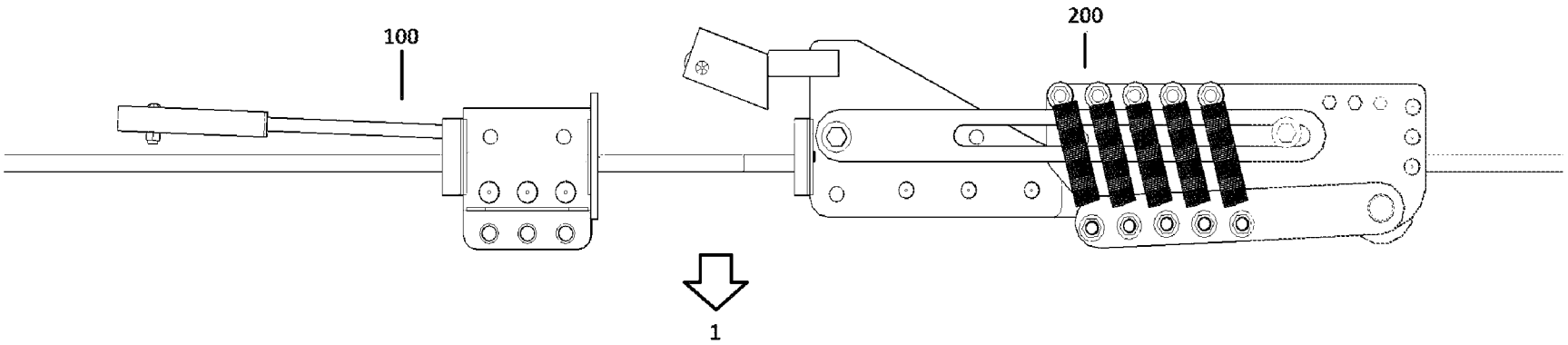
FIG. 1 is an overview showing the preferred embodiment of the compact braking system for zip-line.
Figure 2:
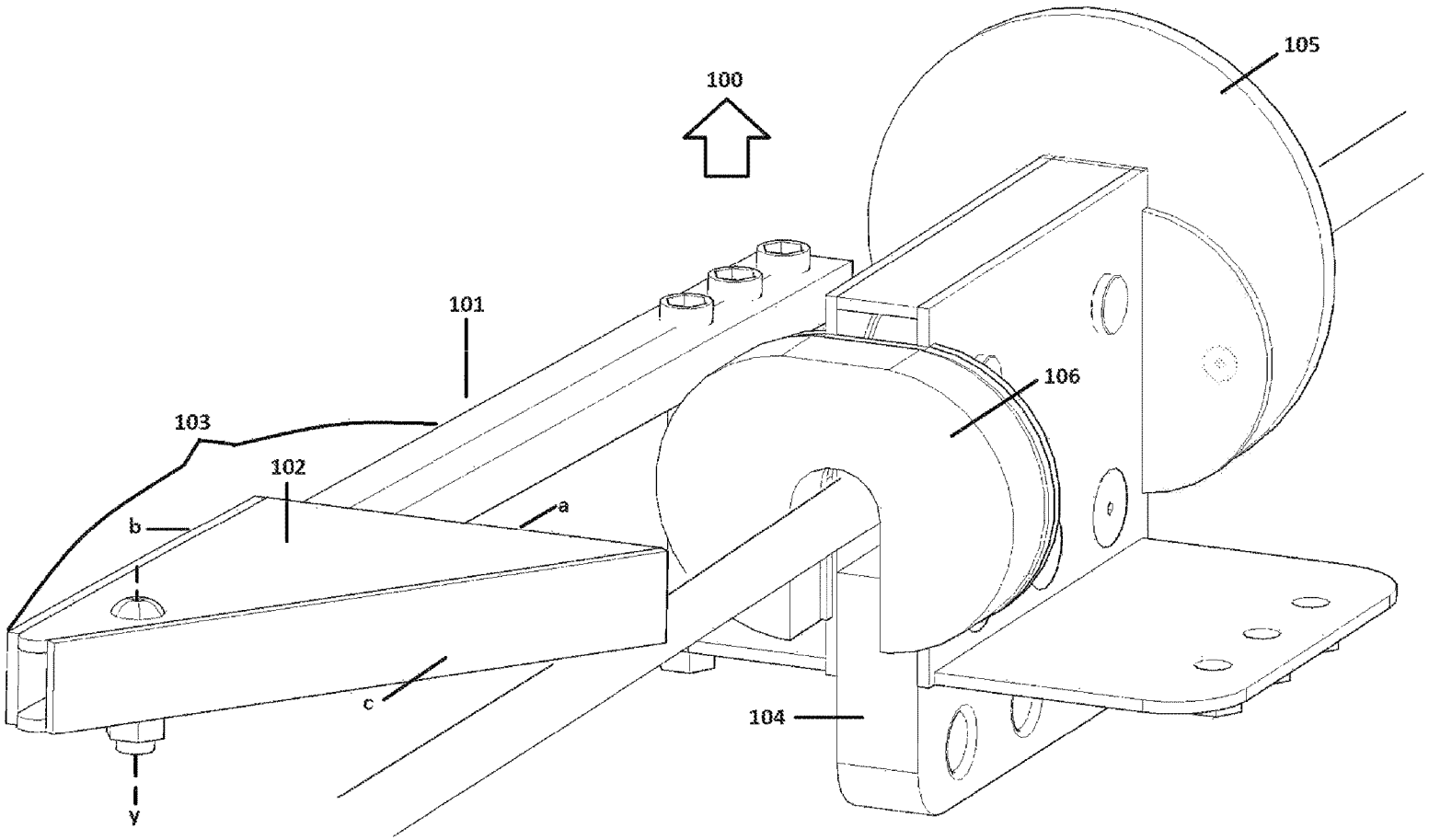
FIG. 2 is a top perspective view showing the anti-return trapping device in accordance with the preferred embodiment of the present invention.

While the present invention is illustrated with reference to a compact, automatic, anti-lock, built-in damping and anti-return zip-line braking system that operates by dissipating and transferring energy and has a particular configuration and contains particular features, the present invention is not limited to this configuration or those features, and other configurations and features themselves may be used which will be within the scope of the present invention by those of ordinary skill in the art.

Similarly, while the description of the present invention is detailed and accurate to enable those of ordinary skill in the art to be able to carry out the invention, the invention may be presented or incorporated in structures other than the illustrative structure shown. The scope of the invention is defined in the claims appended herein.

Currently, the different zip-line systems have braking systems that seek to brake the user's sliding car before it reaches the arrival platform. As is known, the speed of the sliding car increases during the travel due to the inclination of the cable that supports it and the force generated by gravity; If the speed of the sliding car is not controlled and reduced, before its arrival at the end point of the travel, the safety of the user would be compromised when the sliding car hits the arrival platform. Such impact could be fatal for the user.

Given the need set forth in the previous paragraph, the different efforts dedicated to zip-line systems have implemented a vast amount of braking devices or systems. However, said braking devices or systems depend on an operator or the user himself for their activation, or they depend on one or more external cables, independently of the main zip-line cable, and/or elements external to these for their activation and braking; or said zip-line systems, as they contain very large braking devices or systems, are comprised of large structures (arrival platforms) to withstand the impact of the sliding car, which are difficult to install. Also, said braking devices or systems perform braking by means of friction and not by dissipating and transferring the impact energy through a braking device. In turn, said braking devices or systems do not have an anti-return trapping device for the sliding car, an anti-return trapping device that traps and prevents the sliding car from returning on the zip-line after the arrival impact. In addition, such anti-return trapping device can be detached from the braking system to be placed at a certain distance on the zip-line. Other functions of the anti-return trapping device are that it can be carried through the zip-line cable, by means of cables or external elements, until reaching and catching the sliding car, in case the sliding car does not impact with the braking system.

Therefore, the present invention relates to a compact automatic braking system for zip-line with anti-lock, integrated damping and anti-return, which works by dissipating and transferring energy, which aims to guarantee effective and safe braking for the user, avoiding that said braking is aggressive, strong and without the generation of pendulum movements. Furthermore, said braking is activated automatically, that is, without the need for its activation by an operator or a user and without the need to use one or more cables and/or additional external elements.

By way of visualization, FIG. 1 shows a preferred embodiment of the compact braking system for zip-line 1, which is comprised of a trapping device with anti-return 100 and a braking device 200. The compact braking system for zip-line 1, of the present invention, is capable of braking the sliding car (not shown) through the transfer and dissipation of energy generated by the impact of its arrival.

In detail, figure two shows a preferred embodiment of the anti-return trapping device 100, where it is comprised of an anchoring element 101 capable of trapping the slide car (not shown), preventing it from returning up the zip-line after impact. The anchoring element 101 comprises a trigger 102 pivotally coupled at one end 103 of the trapping device with anti-return 100, where said trigger 102 comprises two edge ends a and b and a hypotenuse end c. When the sliding car (not shown) impacts with the hypotenuse end c, the trigger 102 rotates about an axis y allowing the entry of said sliding car (not shown) to the trapping device with anti-return 100 and, once inside it, the trigger 102 returns to its original position by at least one spring (not shown). Conversely, when trigger 102 returns to its original position, blocks the exit of said sliding car (not shown) once trapped by the anchoring element 101.

In a preferred embodiment, the anti-return trapping device 100 has a counterweight 104 allowing balancing and stabilizing the anti-return trapping device 100 on the zip-line cable and, in turn, has a coupling element 105 allowing to engage the braking device 200, when there is an impact between them. Likewise, the anti-return trapping device 100 comprises an impact element 106 coupled thereto, which allows to cushion/absorb the impact of the sliding car (not shown).

In a secondary embodiment, in case the sliding car (not shown) do not impact the anti-return trapping device 100, the anti-return trapping device 100 can be carried through the zip-line cable, by means of cables or external elements, until reaching and catching the sliding car (not shown).

Figure 3:
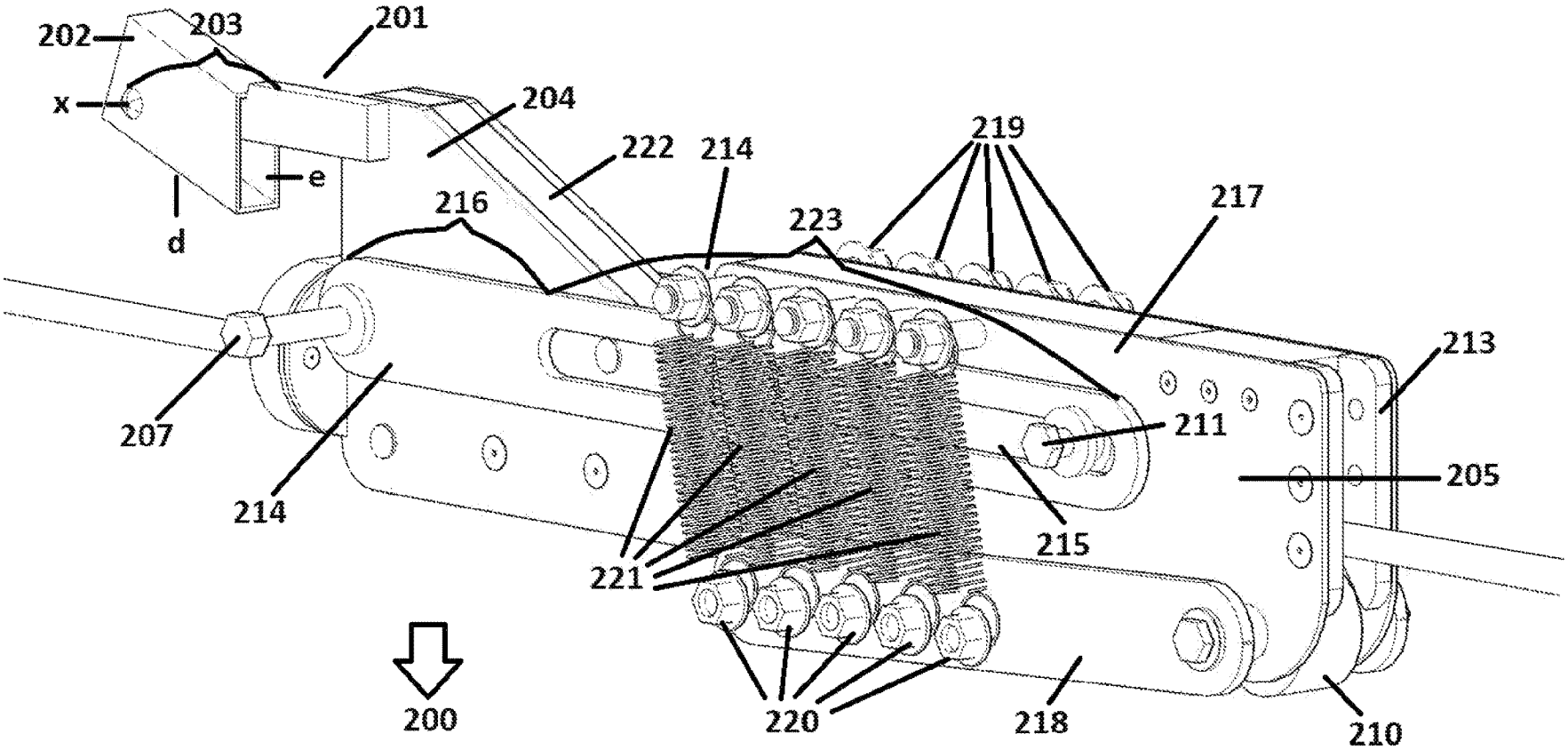
FIG. 3 is a top perspective view that shows the braking device that has elements capable of transferring and dissipating the energy generated by the impact of the arrival of the sliding car according to the preferred embodiment of the present invention.

Now, FIG. 3 shows a preferred embodiment of the braking device 200 which, like the anti-return trapping device 100, also includes an anchoring element 201 capable of trapping said anti-return trapping device 100, preventing it from returning along the zip-line after the impact. Said anchoring element 201 comprises a trigger 202 pivotally coupled at one end 203 of the braking device 200, where said trigger 202 comprises at least two extremes, d and e. When the anti-return trapping device 100 impact the end d, the trigger 202 rotates about its axis x allowing entry of the coupling element 105 to the braking device 200 and, once inside it, the trigger 202 returns to its original position by at least one spring (not shown). Conversely, when trigger 202 returns to its original position, it blocks the exit of said coupling element 105 once caught by the anchor element 201.

Figure 4:
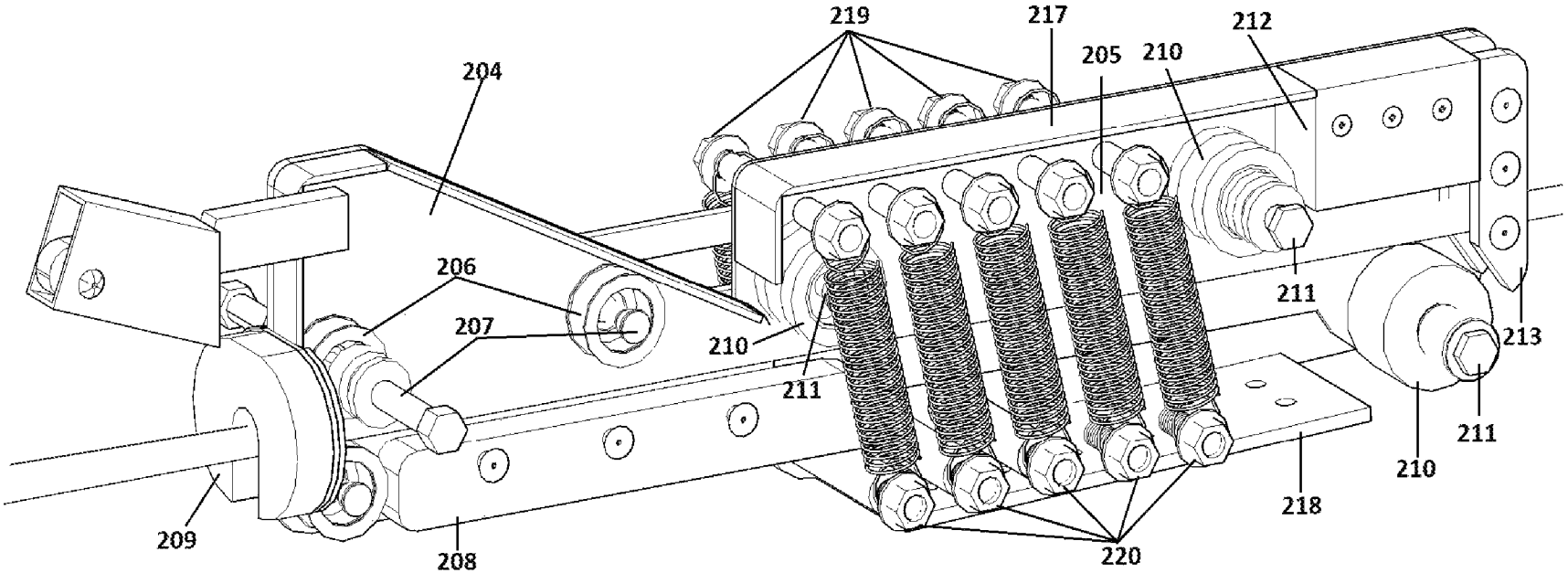
FIG. 4 is a top perspective view showing a cross section of the braking device in accordance with the preferred embodiment of the present invention.

Referring now the FIG. 4, a preferred embodiment of the braking device is shown 200, which is comprised of at least two braking blocks, 204 and 205. The first braking block 204 comprises a first plurality of rotating elements 206 that are pivotally coupled inside it. Each of the first plurality of rotating elements 206 is attached by means of a clamping element 207, which allows it to rotate about its own axis and in turn slide on the zip-line when the first braking block 204 moves thanks to the energy generated by the arrival impact of the sliding car (not shown). It should be mentioned that said first braking block 204, as well as the anti-return trapping device 100, has a counterweight 208 which allows to balance and stabilize it on the zip-line cable.

Like the anti-return trapping device 100, the first braking block 204 comprises an impact element 209 coupled thereto, which allows cushioning the impact of the anti-return trapping device 100.

Now, FIGS. 3 and 4 show the second braking block 205 comprising at least two parts, one upper and one lower, 217 and 218. In addition, it comprises a second plurality of rotating elements 210 that is pivotally coupled inside said at least two parts. Each of the second plurality of rotating elements 210 is attached by means of a clamping element 211, which allows it to rotate about its own axis and in turn slide on the zip-line when the second braking block 205 moves thanks to the energy generated by the arrival impact of the anti-return trapping device 100. In a preferred embodiment, one of the second plurality of rotating elements 210 pivotally couples said at least two parts 217 and 218 of the second braking block 205; that is, said one of the second plurality of rotating elements 210 generates a rotary joint between the parts 217 and 218. Specifically, the upper part 217 comprises a plurality of upper rolling elements 219, which are coupled to a plurality of lower rolling elements 220 of the lower part 218, by means of a plurality of elastic elements 221. By having both the rotary joint between the parts, 217 and 218, by said one of the second plurality of rotating elements 210, as the coupling of the pluralities of upper and lower rolling elements 219 and 220, by means of the plurality of elastic elements 221, a hinge movement is generated in the second braking block 205.

In a secondary embodiment, the second braking block 205 includes a wear element 212 inside, which works as an additional braking element, by applying friction with the zip-line cable, when there is a very large impact on arrival. It should be mentioned that said second braking block 205, as well as the anti-return trapping device 100 and the first braking block 204, has a counterweight 213 which allows to balance and stabilize it on the zip-line cable.

Returning to FIG. 3, both, the first braking block 204 and the second braking block 205, are connected by at least two lever elements 214. In a preferred embodiment, the lever elements 214 are elongated bars, each with a groove/slot 215 along its length l. At least one clamping element 211 of at least one of the second plurality of rotating elements 210 slidably engages over groove 215 of each lever element 214. That is, said groove 215, of each lever element 214, allows the sliding of at least one of the second plurality of rotating elements 210 throughout it.

Similarly, at least one clamping element 207 of at least one of the first plurality of rotating elements 206 is pivotally attached to one end 216 of each lever element 214. That is, it is coupled to the end 216 contrary to the end 223 that has the groove 215, of each lever element 214.

From the above, said at least one of the second plurality of rotating elements 210 has a rotational movement about its axis and translational on the groove 215, of each lever element 214, while said at least one of the first plurality of rotating elements 206 has only a rotational movement about its axis.

It is understood by said at least one clamping element 207 and said at least one clamping element 211, any element belonging to the group of: bolts, prismatic joints or any other means related to sliding and/or rotating clamping means.

In a secondary embodiment, the first braking block 204, the second braking block 205, the anchoring elements 101, 201, the triggers 102, 202, said at least one clamping element 207, 211, the first and second pluralities of rotating elements 206, 210, the lever elements 214, the counterweights 104, 208, 213, the coupling element 105, the anchoring elements 101, 201, the pluralities of upper and lower rolling elements 219, 220, the plurality of elastic elements 221 are made of stainless steel or galvanized steel or aluminum or plastic or any combination thereof.

In a secondary embodiment, the impact elements 105, 209 are made of rubber.

In a secondary embodiment, the wear element 212 is made of wood.

It is of utmost importance to mention that the braking device 200 does not make use of one or more cables and/or elements external thereto. That is, it is only necessary to place said braking device 200 on the zip-line cable. Similarly, it should be noted that the compact braking system for zip-line 1, by having a plurality of elastic elements 221 integrated into the braking device 200, it is no longer necessary to use elastic elements external to the system itself. This allows the compact braking system for zip-line 1 to be much more compact and lighter, taking up much less space on the arrival platform. In the same way, it is very important to emphasize that the compact braking system for zip-line 1 does not brake by means of friction, since it brakes through an accordion movement and a hinge movement, movements that dissipate and transfer energy to the braking device 200. Specifically, the use of the plurality of elastic elements 221 mainly is not to brake the sliding car (not shown) but to cushion the impact of the user and ensure smooth and gradual braking.

It is of utmost importance to mention that the compact braking system for zip-line 1, by dissipating the energy through an accordion movement and a hinge movement and transferring the energy to the braking device 200, there is no wear of friction elements and this significantly reduces maintenance and prolongs the life of the parts included therein. Also, related to the above, the compact braking system for zip-line 1 generates the lever movement that brings the wear element 212 into contact with the zip-line cable; however, this movement is a secondary embodiment and the system of the present invention can do without with this movement. Lastly, due to the versatility and compression of the compact braking system for zip-line 1, a simple and low cost installation is guaranteed. For the installation of the compact braking system for zip-line 1 no additional elements or structures are required in the zip-line cable, that is, no secondary cables, posts, anchors, special platforms or any other external installation element are required. The compact braking system for zip-line 1 is universal, it can be installed on any zip-line cable of any size and by anyone.

The above differences are some of the novel and inventive features over the prior art that exist within the same field of the invention.

Similarly, the compact braking system for zip-line 1 is universal since it allows braking any type of commercial sliding car.

Operation of the Compact Braking System for Zip-Line

The sliding car (not shown) slides along the zip-line until it reaches the anti-return trapping device 100, which is in a position on the zip-line cable. When the sliding car (not shown) reaches to catch device with anti-return 100, it hits the hypotenuse end c of trigger 102 allowing its rotary movement about the axis Y and, allowing the entry of said sliding car (not shown) to the trapping device with anti-return 100. The sliding car (not shown) enters the anti-return trapping device 100, which contains an impact element 105 that dampens the input force of the sliding carriage (not shown). The trigger 102 of anchor element 101 returns to its original position, by means of at least one spring (not shown), once the sliding car (not shown) has entered the trapping device with anti-return 100. Thanks to the impact of the sliding car (not shown) on the impact element 105, this returns trying to get out of the anti-return trapping device 100; however, the edge end a of the trigger 102, which is already in its original position, blocks the exit of said sliding car (not shown).

Figure 5:
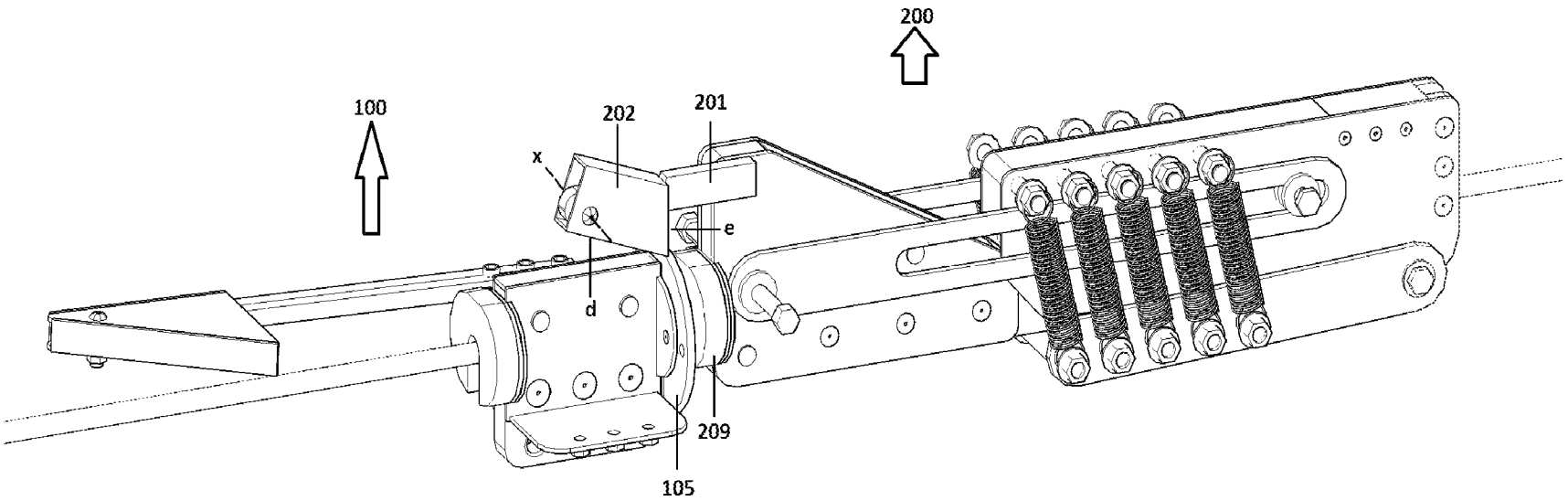
FIG. 5 is an overview of the compact braking system for zip-line showing the travel of the anti-return trapping device when impacted by the sliding car in accordance with the preferred embodiment of the present invention.
Figure 6:
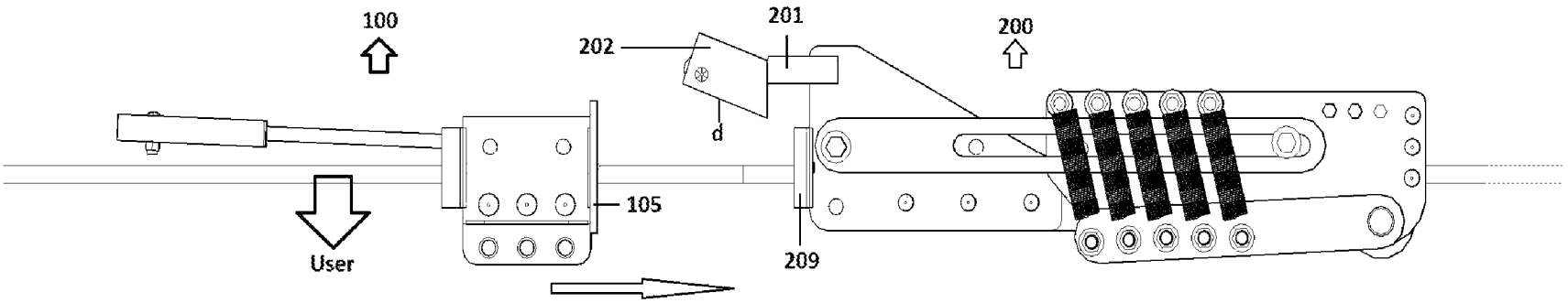
FIG. 6 is an overview of the compact braking system for zip-line showing the impact of the anti-return trapping device on the braking device in accordance with the preferred embodiment of the present invention.
Figure 7:
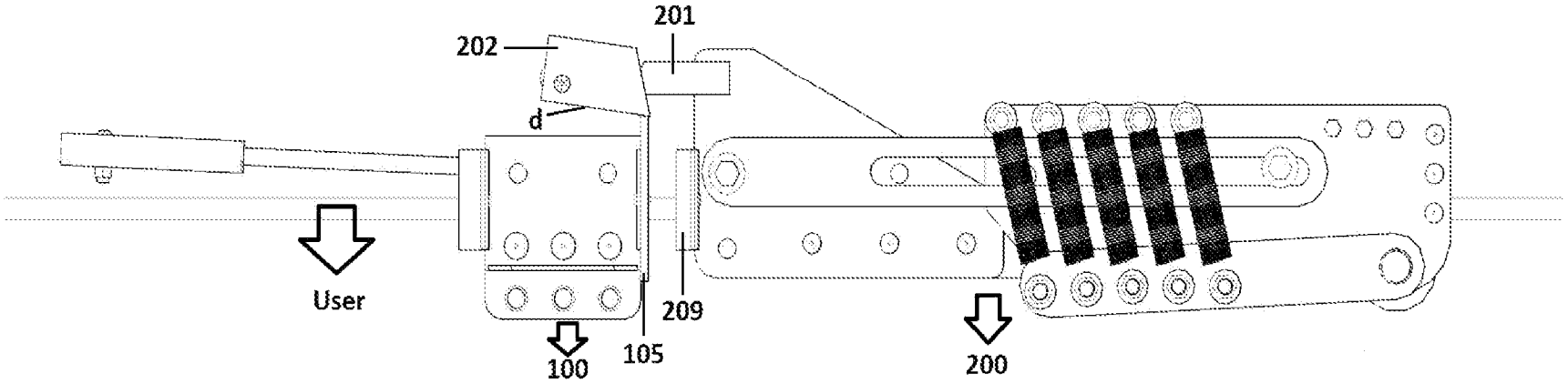
FIG. 7 is a top perspective view of the compact braking system for zip-line showing the anti-return trapping device coupled to the braking device in accordance with the preferred embodiment of the present invention.

FIGS. 5, 6 and 7 show that, once the sliding car (not shown) has been trapped by the anti-return trapping device 100, they slide down the zip-line cable until they reach the braking device 200. When the anti-return trapping device 100 reaches the braking device 200, it hits the end d of trigger 202, allowing its rotary movement about its respective axis x, and allowing the entry of the coupling element 105 of the trapping device with anti-return 100 to braking device 200. The anti-return trapping device 100 enters the braking device 200, which contains an impact element 209 which dampens the input force of the anti-return trapping device 100. The trigger 202 of anchor element 201, returns to its original position, by at least one spring (not shown), once the anti-return trapping device 100 has entered to braking device 200. Thanks to the impact of the anti-return trapping device 100 in the impact element 209, it returns trying to get out of the braking device 200; however, the end e of trigger 202, which is already in its original position, blocks the exit of said anti-return trapping device 100.

Thus, the anchoring element 201 couples and joins the trapping device with non-return 100 with the braking device 200, transferring the energy of the sliding car (not shown) towards the elements comprised by said braking device 200.

Figure 8:
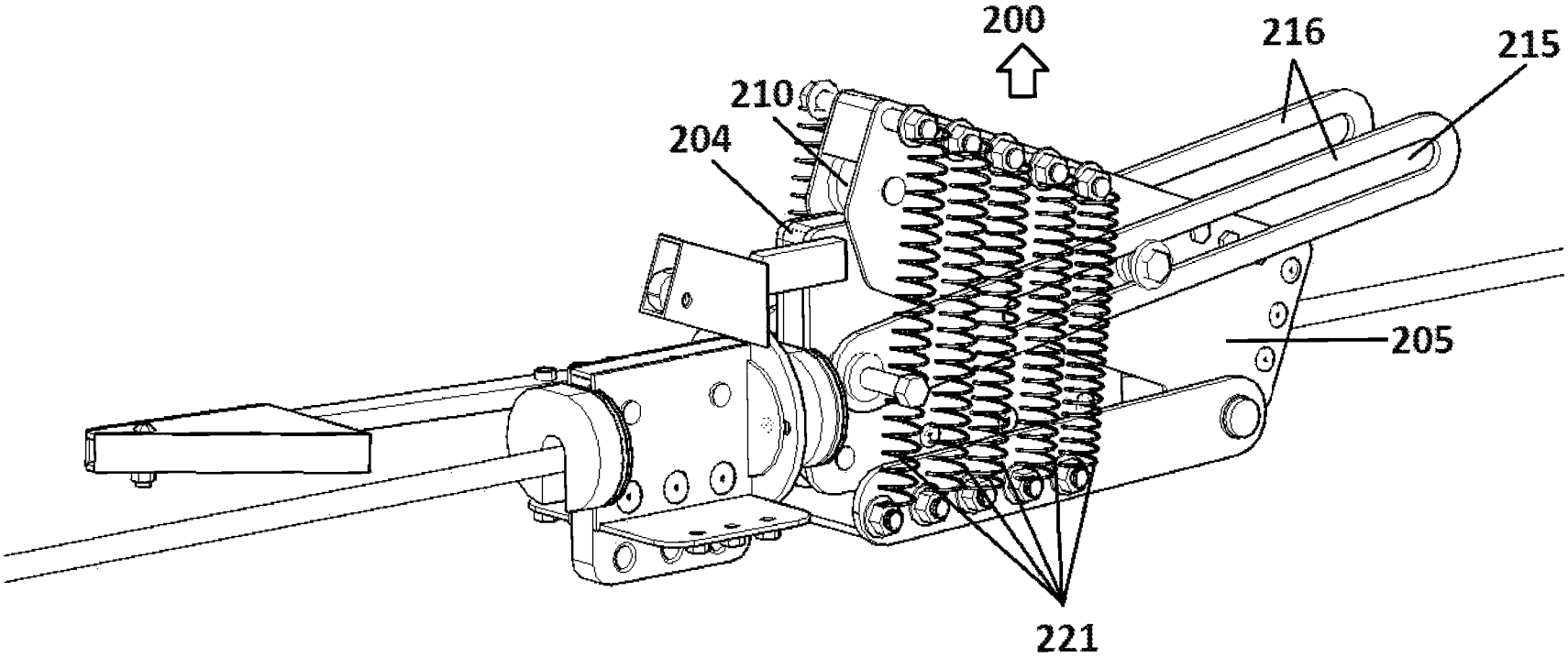
FIG. 8 is a top perspective view of the compact braking system for zip-line to the braking device transferring and dissipating the energy generated by the arrival impact of the sliding car according to the preferred embodiment of the present invention.

Now, FIG. 8, shows that, thanks to the energy transferred to the braking device 200, the first braking block 204 is pushed inside of the second braking block 205. As the first braking block 204 enters into the second braking block 205, the second plurality of rotating elements 210 travel a surface 222 (shown in FIG. 3) of the first braking block 204, as at least one of the second plurality of rotating elements slides 210 through the groove 215 and, turning the end 216 of each lever element 214 about the axis of said at least one of the first plurality of rotating elements 206. In turn, the rotary joint rotates about its axis, allowing said at least two parts 217 and 218 of the second braking block 205 to open, generating the hinge movement in the second braking block 205.

When the energy transferred to the braking device 200 is larger, the second plurality of rotating elements 210 completely travels the surface 222 (shown in FIG. 3), whereas when the energy transferred to the braking device 200 is less, the travel of the second plurality of rotating elements 210 is limited by the plurality of elastic elements 221. In either of the two previous cases, the first braking block 204 enters and exits the second braking block 205, indefinitely until full braking of the sliding car (not shown) is achieved. That is, when entering the first braking block 204 to the second braking block 205, the plurality of elastic elements 221 exert entry and opening resistance of the two parts 217 and 218, thus expelling, the first braking block 204. The first braking block 204 re-enters the second braking block 205, because these are linked by means of the lever elements 214 and thus, the previous steps are repeated successively, generating an accordion movement between said braking blocks, 204 and 205, until the total braking of the sliding car is achieved.

As can be seen from the foregoing, the braking of the sliding car (not shown) is automatically due to the fact that, thanks to the anchoring elements, 101 and 201, and the parts that make up the braking device 200 that allow accordion movement and hinge movement, there is no need to activate the braking manually. It is only necessary for the sliding car (not shown) to impact and be trapped by the anti-return trapping device 100 to automatically activate braking. Similarly, thanks to the above, the braking of the sliding car (not shown) is efficient, without blocking and gradual, thus avoiding strong and aggressive movements in the user.

As a secondary braking measure, use is made of the wear element 212; that is, as the first braking block 204 enters into the second braking block 205, the second braking block 205 is placed above the surface 222, moving the wear item 212 towards the zip-line cable, so that friction is applied between them. This generates a lever movement in the upper part 217.

With the above, a total braking of the sliding car is achieved (not shown) thus guaranteeing effective and safe braking for the user.

In a secondary embodiment, in case the sliding car (not shown) does not impact the anti-return trapping device 100, the anti-return trapping device 100 can be carried through the zip-line cable, by means of cables or external elements, until it reaches and catches the sliding car (not shown).

From the above, two use cases for the compact zip-line braking system are presented. 1. That is, in case the sliding car (not shown) reaches high speeds, it hits the anti-return trapping device directly 100 and subsequently the braking device 200 for a total, effective and safe braking for the user.

In case the sliding car (not shown) does not reach high speeds, it may not impact the anti-return trapping device 100, standing in a position away from the braking device 200, without the possibility of moving to the arrival platform. If the above happens, the anti-return trapping device 100 can be carried through the zip-line cable, by means of cables or external elements, until reaching and catching the sliding car (not shown). Once the sliding car (not shown) has been trapped by the anti-return trapping device 100, these can be taken back to the arrival platform without using the braking device 200.

Thus, the compact braking system for zip-line 1 of the present invention, is presented as a remarkable novelty within its field of application, and with it the aforementioned objective is substantially achieved, showing all the details that characterize it in each of the final claims that accompany the present invention.

The invention claimed is:

1. A compact braking system for zip-line that brakes a sliding car, the system comprising:

an anti-return trapping device that traps the sliding car preventing a return through a zip-line cable; and a braking device that transfers and dissipates an energy of an arrival impact of the sliding car without the use of one or more cables and/or elements external to the braking device and without the activation of an operator and/or user, wherein the braking device comprises:

a first braking block and a second braking block;

an anchoring element comprising a trigger pivotally coupled to one end of the braking device, wherein said trigger allows entry and blocks an exit of the anti-return trapping device of the anchoring element;

an element of impact that dampens an input force of the anti-return trapping device; and at least two lever elements connecting and allowing a first braking block and the second braking block to slide.

2. The compact braking system for zip-line according to claim 1, wherein the anti-return trapping device includes an anchoring element, which comprises:

a trigger pivotally coupled to one end of the anti-return trapping device, wherein said trigger allows entry and blocks exit of the sliding car of the anchoring element;

a coupling element that allows coupling between the anti-return trapping device and the braking device; and an element of impact that dampens an input force of the sliding car.

3. The compact braking system for zip-line according to claim 1, wherein when the sliding car does not impact the anti-return trapping device, the anti-return trapping device can be carried through the zip-line cable, by means of one or more cables and/or external elements, until the anti-return trapping device reaches and catches the sliding car.

4. The compact braking system for zip-line according to claim 3, wherein one or more cables and/or external elements are safety cables or any other secondary safety element.

5. The compact braking system for zip-line according to claim 1, wherein the first braking block comprises a first plurality of rotating elements that are pivotally coupled inside it.

6. The compact braking system for zip-line according to claim 5, wherein each of the first plurality of rotating elements is coupled by means of a clamping element, which allows to rotate about an axis and, in turn, to slide on the zip-line cable.

7. The compact braking system for zip-line according to claim 1, wherein the second braking block comprises a second plurality of rotating elements that are pivotally coupled inside it.

8. The compact braking system for zip-line according to claim 7, wherein each of the second plurality of rotating elements is coupled by means of a clamping element, which allows to rotate about an axis and in turn slide on the zip-line cable.

9. The compact braking system for zip-line according to claim 1, wherein the at least two lever elements are elongated bars, each with a groove along its length l.

10. The compact braking system for zip-line according to claim 8, wherein at least one clamping element of said at least one of the second plurality of rotating elements is slidingly engaged over a groove of each of the at least two lever elements.

11. The compact braking system for zip-line according to claim 1, wherein at least one clamping element of said at least one of the first plurality of rotating elements is pivotally coupled to one end of a lever member, as opposed to an end having a groove, of the lever member.

12. The compact braking system for zip-line according to claim 1, wherein the second braking block comprises at least two parts, an upper one and a lower one, wherein said parts are pivotally coupled by means of one of a second plurality of rotating elements, generating a rotating joint between them.

13. The compact braking system for zip-line according to claim 12, wherein the upper part comprises of a plurality of upper rolling elements and the lower part comprises of a plurality of lower rolling elements, wherein the plurality of upper and lower rolling elements is coupled by means of a plurality of elastic elements.

14. The compact braking system for zip-line according to claim 12, wherein the rotating joint between the parts, by means of said one of the second plurality of rotating elements, and the coupling of the pluralities of upper and lower rolling elements, by means of a plurality of elastic elements, generates a hinge movement in the second braking block.

15. The compact braking system for zip lines according to claim 1, wherein the first braking block is pushed inside the second braking block due to an energy transferred to the braking device and, it exits the second braking block due to a resistance of a plurality of elastic elements.

16. The compact braking system for zip-line according to claim 15, wherein an entry and exit of the first braking block is repeated indefinitely, generating an accordion movement until a total braking of the sliding car is achieved.

17. The compact braking system for zip-line according to claim 15, wherein, when an energy transferred to the braking device is greater than the energy generated by the impact of the arrival of the sliding car, the second plurality of rotating elements completely travels a surface of the first braking block, while, when the energy transferred to the braking device is less than the energy generated by the impact of the arrival of the sliding car, the travel of the second plurality of rotating elements is limited by the plurality of elastic elements.

18. The compact braking system for zip lines according to claim 1, wherein, upon entering the first braking block to the second braking block, a lever movement is generated and moves a wear element towards the zip-line, so that friction is applied between them.

19. The compact braking system for zip-line according to claim 1, wherein:

a wear element is made of wood;

clamping elements belong to the group of bolts, prismatic joints or any other means related to sliding and/or rotating clamping means;

said trapping device with anti-return, the first braking block and the second braking block, each has a counterweight allowing to balance and stabilize it on the zip-line cable;

impact elements are made of rubber; and the first braking block, the second braking block, anchoring elements, triggers, the clamping elements, a first and second pluralities of rotating elements, the at least two lever elements, Counterweights, coupling element, the anchoring elements, pluralities of upper and lower rolling elements and plurality of elastic elements are made of stainless steel or galvanized steel or aluminum or plastic or any combination thereof.

* * * * *